US009272200B2

(12) United States Patent
Ziemkowski et al.

(10) Patent No.: US 9,272,200 B2
(45) Date of Patent: Mar. 1, 2016

(54) SPORT COURT PERIMETER BOUNDARY

(76) Inventors: Theodore B. Ziemkowski, Windsor, CO (US); David W. Boyd, Greeley, CO (US)

( * ) Notice: Subject to any disclaimer, the term of this patent is extended or adjusted under 35 U.S.C. 154(b) by 899 days.

(21) Appl. No.: 11/726,057

(22) Filed: Mar. 20, 2007

(65) Prior Publication Data

US 2007/0232418 A1 Oct. 4, 2007

Related U.S. Application Data

(60) Provisional application No. 60/788,268, filed on Mar. 31, 2006.

(51) Int. Cl.

| | |
|---|---|
| ***A63B 67/00*** | (2006.01) |
| ***A63C 19/06*** | (2006.01) |
| ***A63B 71/02*** | (2006.01) |

(52) U.S. Cl.

CPC ..... *A63C 19/065* (2013.01); *A63B 71/02* (2013.01); *A63B 2071/024* (2013.01); *A63B 2102/04* (2015.10); *A63B 2243/0095* (2013.01)

(58) Field of Classification Search

CPC ..... A63B 2243/0095; A63B 2243/0087; A63B 2071/024; A63C 19/065

USPC ..... 473/415, 474, 490, 478, 473; 273/398; 33/759, 756, 755, 732, 413

See application file for complete search history.

(56) References Cited

U.S. PATENT DOCUMENTS

| | | | | | |
|---|---|---|---|---|---|
| 603,157 | A | * | 4/1898 | Spitzenberg | B44D 3/38 256/39 |
| 1,605,662 | A | * | 11/1926 | Rowland | 473/474 |
| 2,524,596 | A | * | 10/1950 | Kamp | 33/413 |
| 3,039,197 | A | * | 6/1962 | Abbott | 33/456 |
| 3,066,416 | A | * | 12/1962 | Gutting | 33/1 F |
| 3,393,913 | A | * | 7/1968 | Safina | 273/118 R |
| 3,504,914 | A | * | 4/1970 | Bradbury | 273/118 R |
| 3,668,781 | A | * | 6/1972 | Teter | 33/1 H |
| 3,968,968 | A | * | 7/1976 | Peterson | 473/473 |
| 3,985,359 | A | * | 10/1976 | Moore | 473/473 |
| 4,160,324 | A | * | 7/1979 | Dunn | 33/759 |
| 4,381,607 | A | * | 5/1983 | Place | 33/1 G |
| 4,575,943 | A | * | 3/1986 | Baum, Jr. | 33/759 |

(Continued)

OTHER PUBLICATIONS

Calculus with Analytic Geometry—Fifth Edition 1995—Howard Anton, Drexel University—John Wiley & Sons, Inc.—pp. A4 and A5.*

(Continued)

*Primary Examiner* — Mitra Aryanpour

(57) ABSTRACT

An improved court perimeter boundary for volleyball or other sports comprises at least one indicator that indicates a hypotenuse distance to be used in squaring the court delimited by the boundary. Optionally, the perimeter boundary may be separated, facilitating the setup of the court and the winding of the boundary for storage. A method of setting up a volleyball court is also described.

18 Claims, 10 Drawing Sheets

(56) References Cited

U.S. PATENT DOCUMENTS

| | | | | | |
|---|---|---|---|---|---|
| 4,880,243 | A * | 11/1989 | Raub | 473/490 | |
| 5,107,595 | A * | 4/1992 | Stay et al. | 33/1 G | |
| D338,699 | S * | 8/1993 | Bader | D21/706 | |
| 5,371,949 | A * | 12/1994 | Delaurier | 33/1 G | |
| 5,417,438 | A * | 5/1995 | Poff | 473/415 | |
| 5,427,383 | A * | 6/1995 | Viens | 473/490 | |
| 5,735,094 | A * | 4/1998 | Zember | B28B 11/0818 | 427/282 |
| 5,741,194 | A * | 4/1998 | Simunek | 473/490 | |
| 6,010,416 | A * | 1/2000 | Frederick | 473/490 | |
| 6,141,880 | A | 11/2000 | Vircks | | |
| 6,386,997 | B1 * | 5/2002 | Brown | 473/490 | |
| 6,421,926 | B1 * | 7/2002 | Cappuccio | E01C 23/01 | 33/1 H |
| 6,854,189 | B2 * | 2/2005 | Schafer | B26B 29/06 | 33/1 B |
| 6,907,708 | B2 * | 6/2005 | Naji | C04B 28/02 | 106/716 |
| 6,978,553 | B2 * | 12/2005 | Doublet | 33/756 | |
| 2002/0148195 | A1 * | 10/2002 | Ward | B28B 7/0011 | 52/742.1 |
| 2003/0079360 | A1 * | 5/2003 | Ziegler | G01B 21/047 | 33/562 |
| 2007/0032317 | A1 * | 2/2007 | Frederick | 473/490 | |
| 2007/0232418 | A1 * | 10/2007 | Ziemkowski et al. | 473/415 | |
| 2008/0312002 | A1 * | 12/2008 | Cengarle et al. | 472/92 | |
| 2010/0180459 | A1 * | 7/2010 | Redmond | A63C 19/08 | 33/562 |

OTHER PUBLICATIONS

Geometry "The Measurement of Land"—http://www.thefleece.org/geometry.html.*

The Pythagorean Theorem, by: Stephanie J. Morris (Figure 9) http://jwilson.coe.uga.edu/emt669/student.folders/morris.stephanie/emt.669/essay.1/pythagorean.html.*

The theorem of Phythagoras (chapter 8).*

Framing Basics by Rick Peters © 2000 p. 43 http://books.google.com/books?id=oNTAFoj1FQsC&pg=PA43&lpg=PA43&dq=framing+square+angles+hypotenuse+rope&source=bl&ots=vKYLy_yZ83&sig=o5HwjSZwJUz-GCMgv16zBGhBSRc&h1=en&sa=X&ei=n3-kU4rtManksAT-0oH4Dg&ved=0CCUQ6AEwAw#v=onepage&q=framing%20square%20angles%20hypotenuse%20rope&f=false.*

Various methods of measuring and/or laying out a space.*

How to layout a soccer field http://assets.ngin.com/attachments/document/0048/4895/How_to_Lay_Out_a_Soccer_Field_from_Goal_Line.pdf.*

North Austin Soccer Alliance, how to layout a soccer field http://www.northaustinsoccer.org/Handbook/field-layout.*

How to layout a square area—eHow.*

* cited by examiner

SPORT COURT PERIMETER BOUNDARY

CROSS REFERENCE TO RELATED APPLICATIONS

This application claims priority from provisional application No. 60/788,268, filed Mar. 31, 2006 and titled "Sport court perimeter boundary". That provisional application is hereby incorporated by reference as if fully reproduced herein.

BACKGROUND

FIG. 1 shows an outdoor volleyball court 100. The typical court is a rectangular area about 9 meters (29.53 feet) in width by 18 meters (59.06 feet) in length, outlined by perimeter court boundary 101 and bisected by a net 102. Often, the court perimeter boundary 101 is formed by a flexible rope or tape, anchored to the ground at the corners. The flexible perimeter boundary material aids in play because motion of the boundary when it is hit by a falling ball makes it easy to determine whether a ball has fallen in bounds or out of bounds.

Different volleyball organizations may use somewhat different court sizes. For example, outdoor professional beach volleyball in the United States is often played on a court that is 8×16 meters (26.25 by 52.49 feet).

In any case, the court perimeter boundary 101 should outline a rectangle, each corner forming a right angle. If the figure formed by the perimeter boundary 101 is not an accurate rectangle, for example if the figure is a parallelogram or other shape, the game may be made more difficult or unfair.

SUMMARY OF THE INVENTION

An improved court perimeter boundary for volleyball or other sports comprises at least one indicator that indicates a hypotenuse distance to be used in squaring the court delimited by the boundary, and is separable for easy winding.

DETAILED DESCRIPTION

Figure 1:
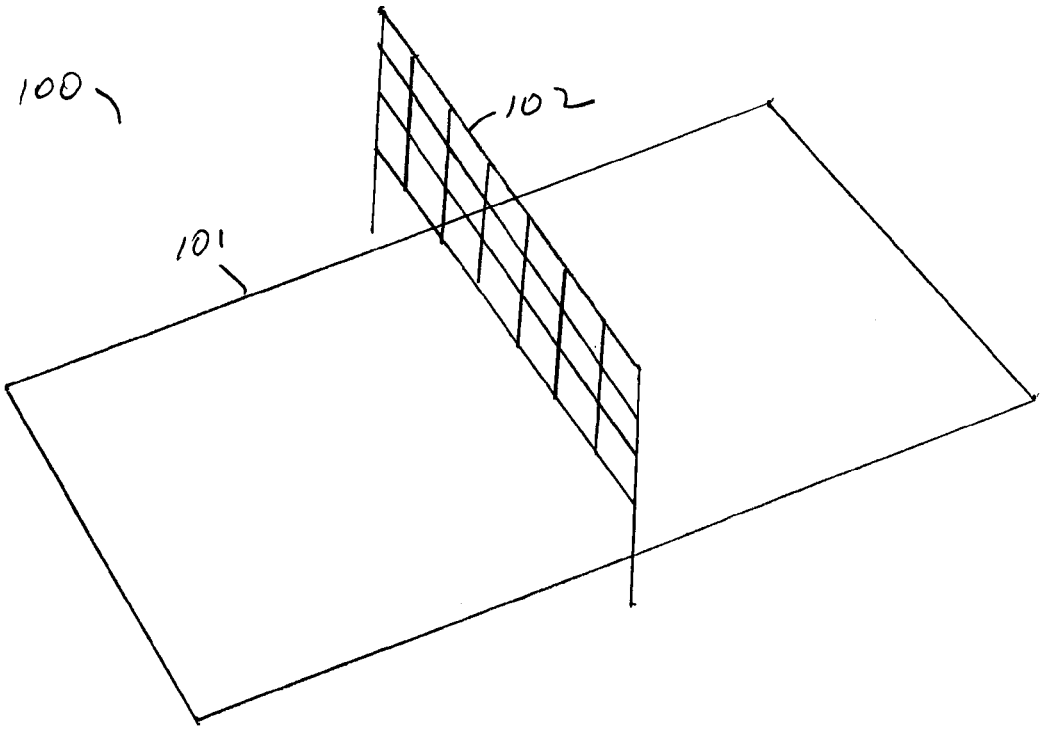
FIG. 1 shows a volleyball court.
Figure 2:
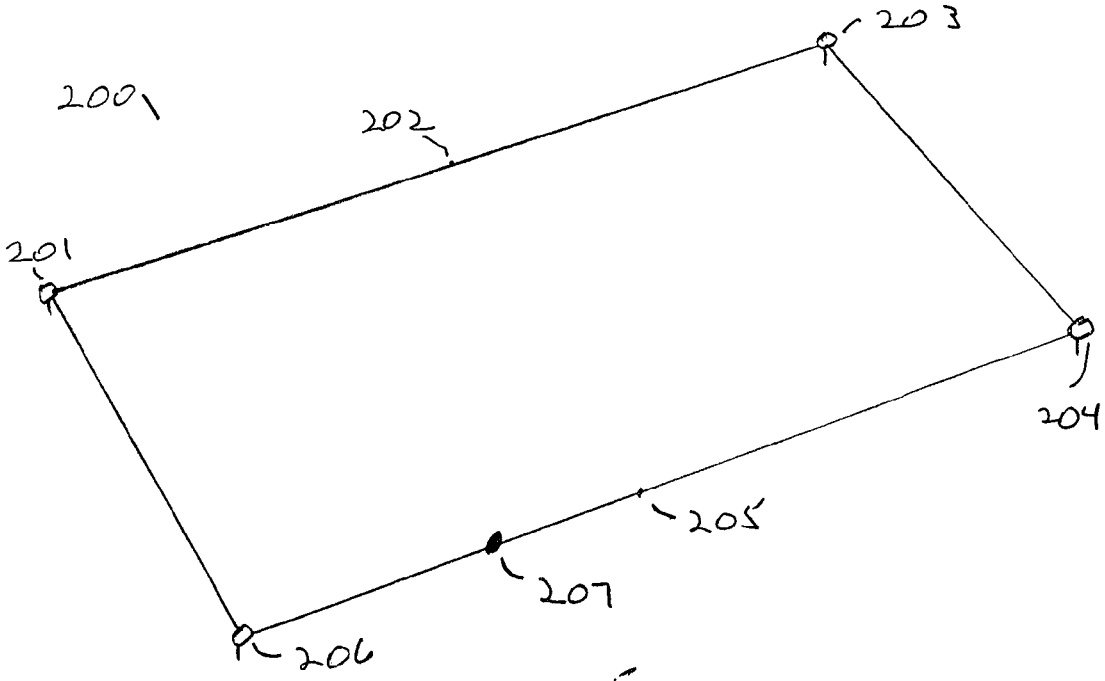
FIG. 2 shows volleyball court perimeter boundary in accordance with a first example embodiment of the invention.

FIG. 2 shows a court perimeter boundary 200 in accordance with a first example embodiment of the invention. Court perimeter boundary 200 is especially suitable for constructing a volleyball court, but may be suitable for use in other sports, for example badminton. Each perimeter segment is preferably made of an elongate, flexible material, for example nylon rope, woven webbing, or a similar material. Preferably, the material is chosen for good durability and high visibility. The segments may be separate pieces of the boundary material joined at the corners, or each segment may be a portion of a continuous boundary on which corner locations are designated. The segments form four corners 201, 203, 204, 206. Midpoints 202 and 205 are located at the midpoints of the two long sides of the court. Preferably, anchors are provided for securing the corners of perimeter boundary 200 to the ground. Optionally, anchors may be provided for securing the perimeter boundary to the ground at midpoints 202 and 205 as well.

Figure 3:
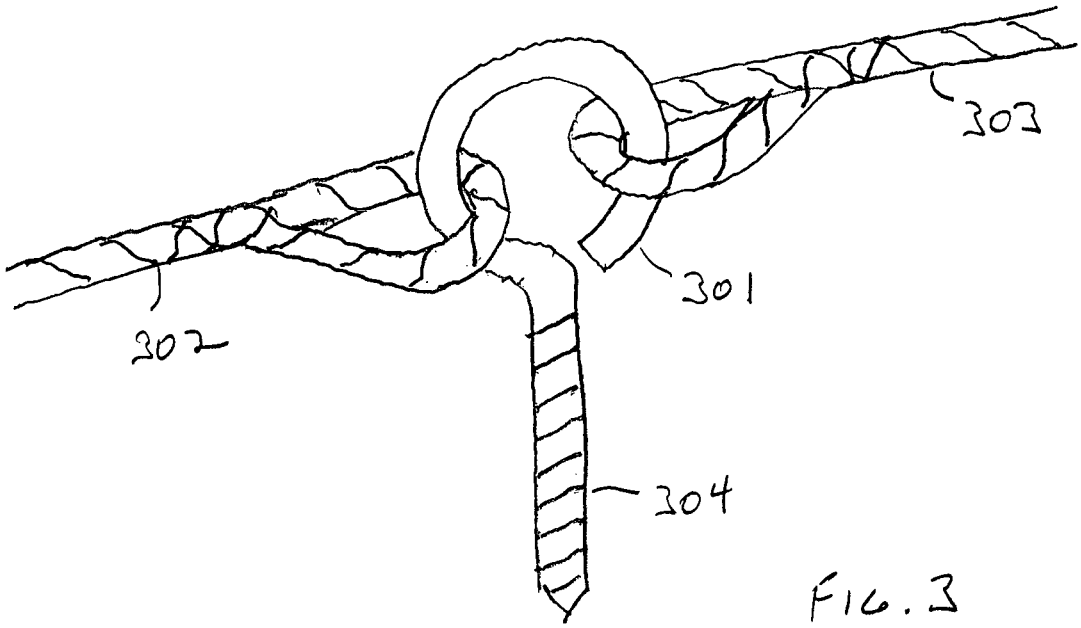
FIG. 3 shows a first example anchor joining two segments of a court perimeter boundary.

Any of a number of types of anchors may be used within the scope of the appended claims. FIG. 3 shows a first example anchor 301, joining two perimeter segments 302 and 303. In the example of FIG. 3, anchor 301 is a 5/16 inch (8 mm) eye bolt, approximately 3 inches (75 mm) long. Example perimeter segments 301 and 302 are made of nylon rope and are attached to anchor 301 by braiding. Other attachment methods may be used as well. For example, segments 301 and 302 could be tied to anchor 301. Anchor 301 may be secured to the ground by simply pushing its threaded portion 304 downward into the ground.

Figure 4:
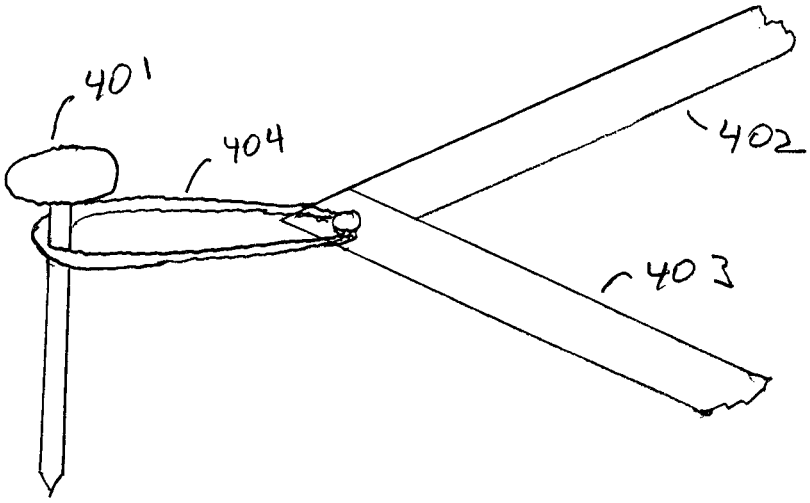
FIG. 4 shows a second example anchor that anchors a corner formed by two perimeter segments.

FIG. 4 shows a second example anchor 401 that anchors a corner formed by perimeter segments 402 and 403. In the example of FIG. 4, perimeter segments 402 and 403 are made of woven nylon webbing. Anchor 401 is a spike to be driven into the ground, and is attached using a rubber tension cord 404 to the corner formed by segments 402 and 403.

Figure 5:
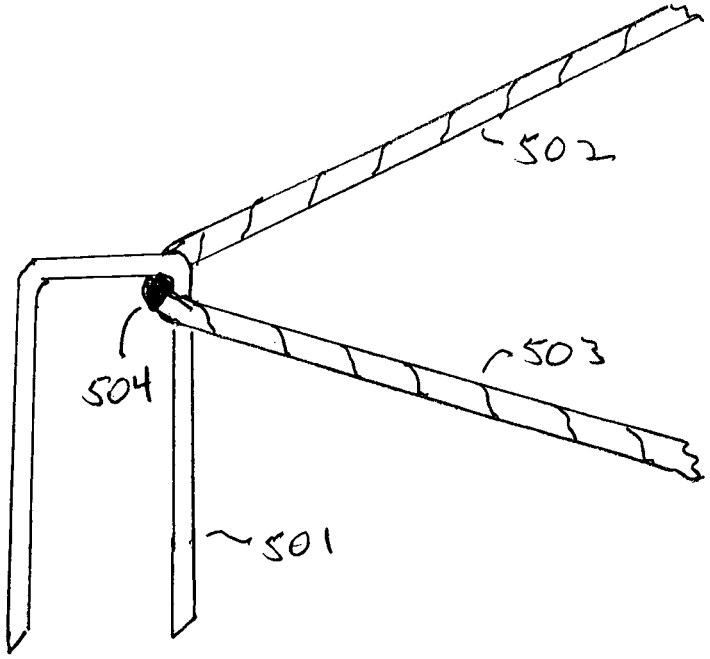
FIG. 5 shows a third example anchor that anchors a corner formed by two perimeter segments.

FIG. 5 shows a third example anchor 501 that anchors a corner formed by perimeter segments 502 and 503. In the example of FIG. 5, perimeter segments 502 and 503 are part of a continuous boundary on which mark 504 indicates the corner. Anchor 501 may be made, for example, of a wire staple of a kind commonly used in landscaping. One of skill in the art will recognize that many other anchoring systems may be used within the scope of the appended claims.

Referring again to FIG. 2, perimeter boundary 200 comprises at least one hypotenuse distance indicator 207 to be used in squaring the court. In this example embodiment, hypotenuse distance indicator 207 is preferably a mark made on boundary 200 using an indelible ink or paint of a color that contrasts with the boundary material. Alternatively, indicator mark 207 may be integrally formed by weaving fibers of a contrasting color into boundary 200, may be a device crimped or clamped onto boundary 200 at the proper location, or may be formed in some other way.

Figure 6A:
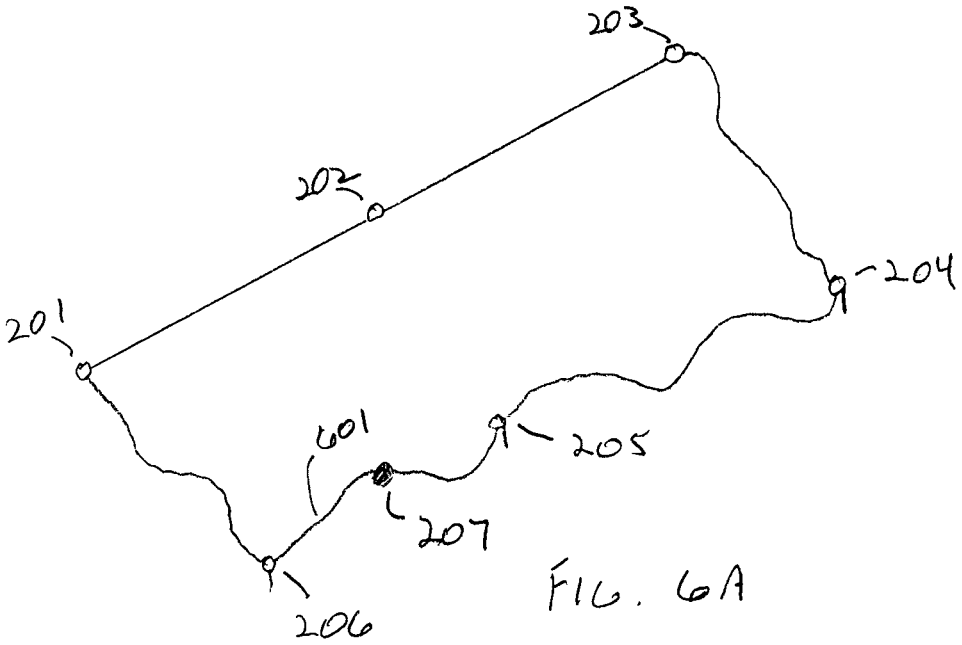
FIGS. 6A-6C illustrate the setup of the example perimeter boundary of FIG. 2.
Figure 6B:
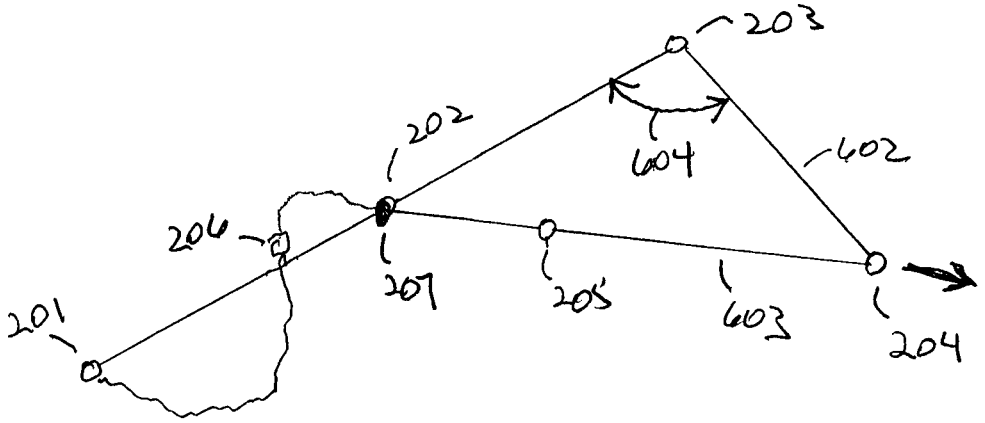
Figure 6C:
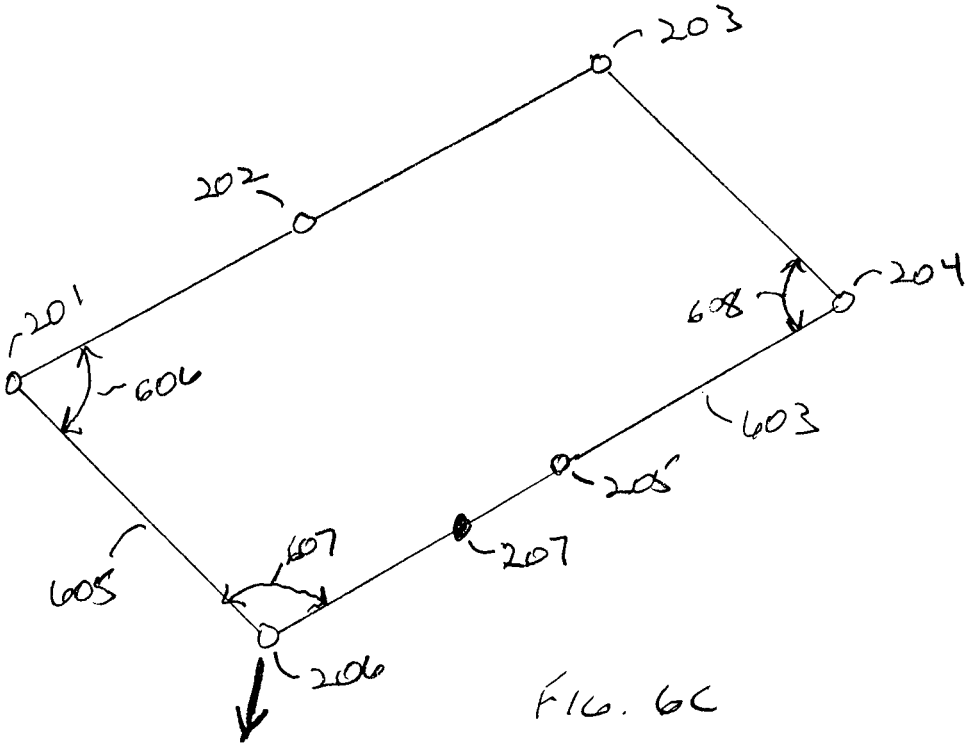

FIGS. 6A-6C illustrate the setup of perimeter boundary 200, and the use of hypotenuse distance indicator mark 207, in accordance with an example embodiment of the invention. In a first step, illustrated in FIG. 6A, corners 201 and 203 and midpoint 202 are secured to the ground, forming an initial side of the rectangular court. Hypotenuse distance indicator mark 207 is on a segment 601 not included between corners 201 and 203.

In a second step, illustrated in FIG. 6B, adjacent corner 204 is moved to its approximate final location, and hypotenuse distance indicator 207 is held at a preselected point on the initial side. In this example, the preselected point is midpoint 202. Corner 204 is then pulled until segments 602 and 603 are taut. This portion of the setup can easily be performed by two people, one holding hypotenuse distance indicator 207 at midpoint 202, and one pulling on corner 204 until segments 602 and 603 are taut. Because the distance from corner 204 to indicator 207 is a hypotenuse distance that is $\sqrt{2}$ times the width of the court, and because the distance from corner 203 to midpoint 202 is the same as the distance from corner 203 to corner 204, interior angle 604 is a right angle. For example, if perimeter boundary 200 forms a court 9 meters (29.53 feet) in width by 18 meters (59.06 feet) in length, the distance from corner 204 to hypotenuse distance indicator 207 is $9\times\sqrt{2}$ meters, or 12.728 meters (41.76 feet). Once the right triangle is formed by pulling corner 204 to its proper position, corner 204 is secured to the ground. While the example embodiments describe a court whose length is twice its width, one of skill in the art will easily recognize that the invention may be embodied, with suitable adjustments to the placement of the hypotenuse mark, in courts with different aspect ratios.

FIG. 6C illustrates the final steps in the setup of example perimeter boundary 200. Corner 206 is pulled until perimeter segments 603 and 605 are taut. Because corner 204 has been placed and anchored in its proper location in relation to corners 201 and 203, corner 206 is also automatically placed in the proper location to form perimeter boundary 200 into a rectangle. That is, the remaining interior angles 606, 607, 608 are also right angles. Corner 206, and optionally midpoint 205, may then be secured to the ground.

Figure 7:
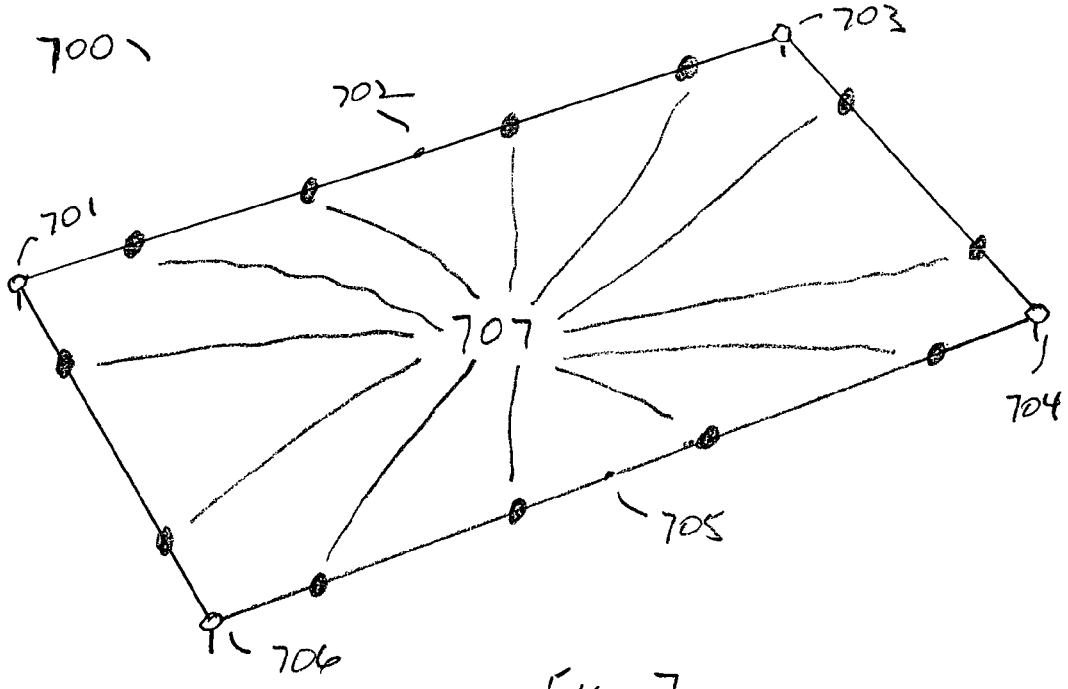
FIG. 7 illustrates a court perimeter boundary in accordance with a second example embodiment of the invention.

FIG. 7 illustrates a court perimeter boundary 700 in accordance with a second example embodiment of the invention. Perimeter boundary 700 comprises four corners 701, 703, 704, and 706, and two side midpoints 702 and 705. Preferably, each corner and midpoint is fitted with an anchor that will serve equally well as a corner anchor or a midpoint anchor. For example, an anchor of the type illustrated in FIG. 3 could be used. Thus, perimeter boundary 700 comprises six points that could serve as corners of a court. Even if the anchors used at the midpoints are different from the anchors used at the corners, a perimeter boundary in accordance with this example embodiment would have four points that can serve as corners. Perimeter boundary 700 also comprises 12 hypotenuse distance indicators 707, each placed a hypotenuse distance away from one of the points that can serve as corners. For example, if boundary 700 is to form a court 9×18 meters (29.53 by 59.06 feet), then hypotenuse distance indicator marks 707 may be placed on boundary 700 at 12.728 meters (41.76 feet) from each corner or midpoint, in both directions around the perimeter. Having multiple hypotenuse indicators placed in this way makes completely arbitrary the choice of which boundary segment end to start with in setting up a court. Any two adjacent segments may be used to form the initial long court side, and the segment adjacent either end of that initial side may be used to form the initial right angle. One of hypotenuse distance indicators 707 will always be available to hold near the preselected point on the initial side during the squaring up of the initial right angle.

Figure 8A:
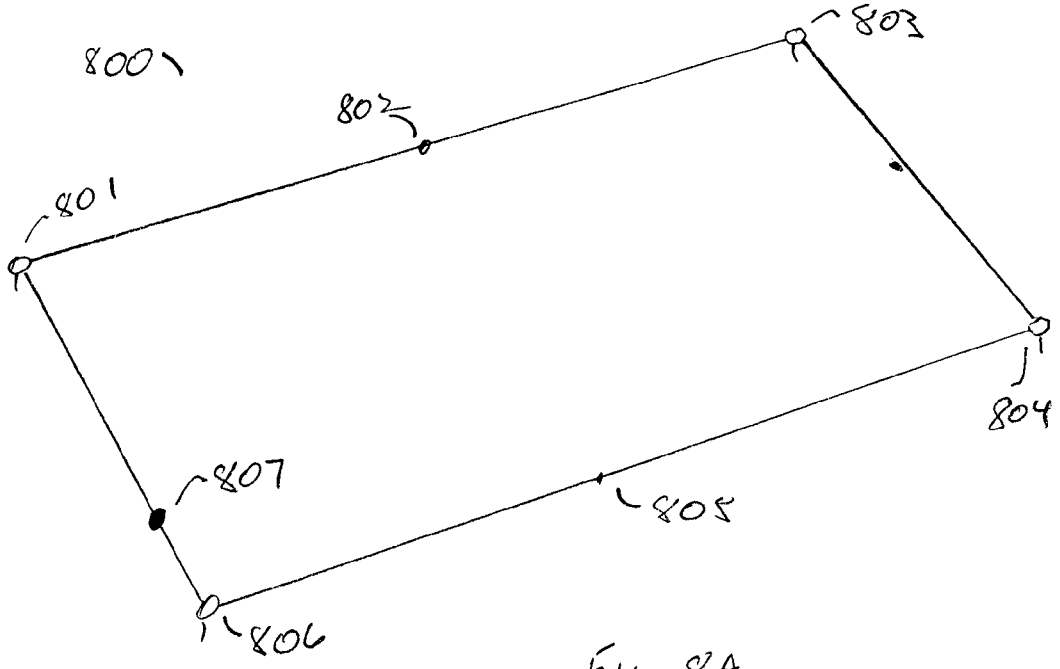
FIGS. 8A and 8B illustrate a court perimeter boundary in accordance with a third example embodiment of the invention, and some steps involved in its setup.
Figure 8B:
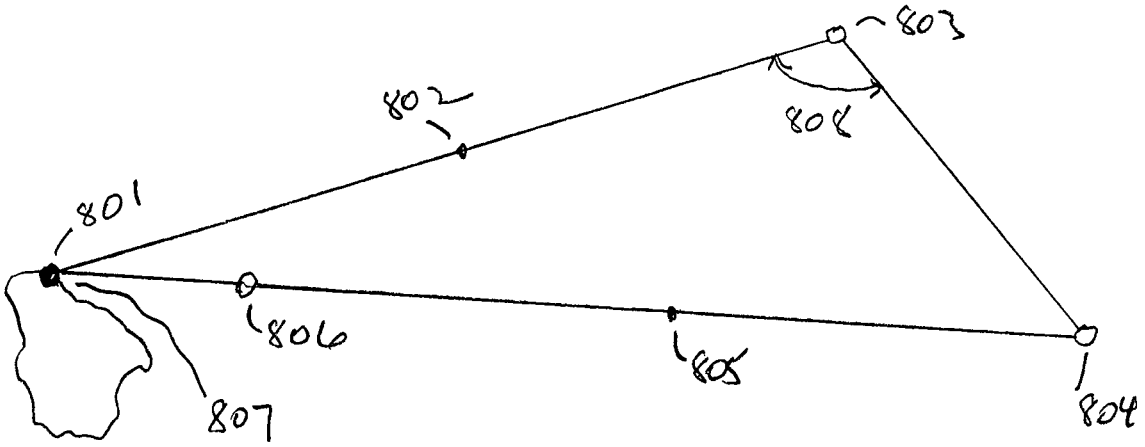

FIGS. 8A and 8B illustrate a court perimeter boundary 800 in accordance with a third example embodiment of the invention, and some steps involved in its setup. Perimeter boundary 800 comprises corners 801, 803, 804, and 806, and long side midpoints 802 and 805. Perimeter boundary 800 also comprises a hypotenuse indicator 807, placed a hypotenuse distance away from corner 804. In this example embodiment, the distance from corner 804 to hypotenuse distance indicator mark 807 along the boundary is $\sqrt{5}$ times the width of the court, and the court is twice as long as it is wide. For example, if perimeter boundary 800 is to form a court 9×18 meters (29.53 by 59.06 feet), then indicator mark 807 is placed $9\times\sqrt{5}$ or 20.125 meters (66.03 feet) from corner 804. As is illustrated in FIG. 8B, during the setup of perimeter boundary 800, hypotenuse distance indicator 807 is held at corner 801 while corner 804 is pulled into place and anchored, ensuring that angle 808 is a right angle. Corner 806 may then be pulled into place and anchored. Multiple hypotenuse indicators 807 may be placed on perimeter boundary 800 to make arbitrary the choice of the perimeter segment used to begin the setup.

Figure 9A:
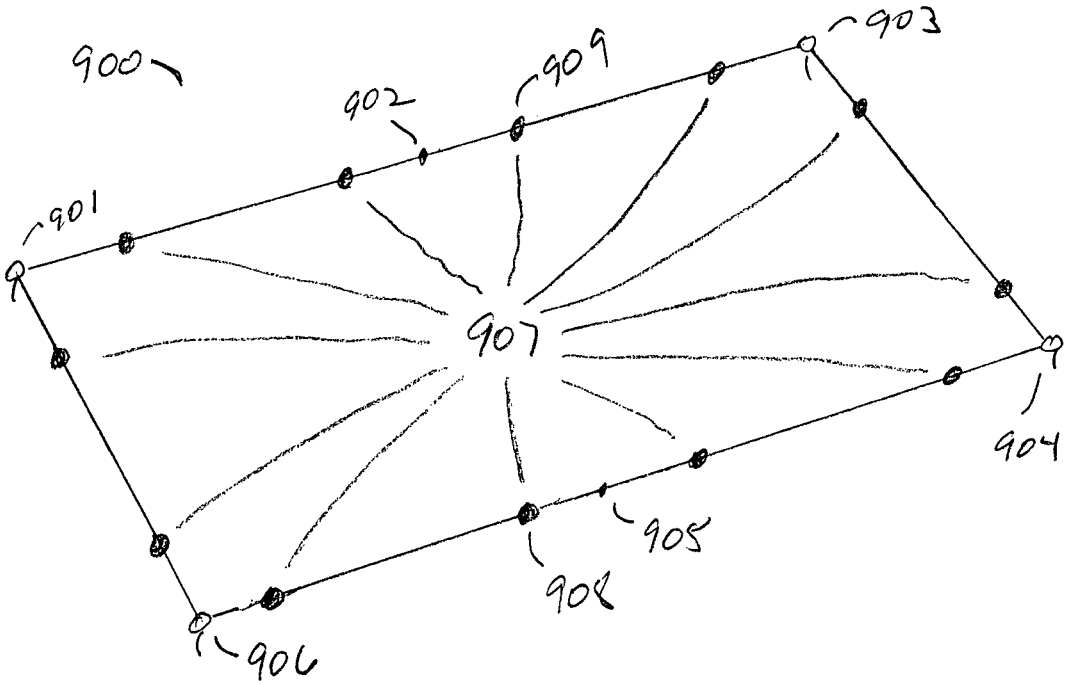
FIGS. 9A and 9B illustrate a court perimeter boundary in accordance with a fourth example embodiment of the invention.
Figure 9B:
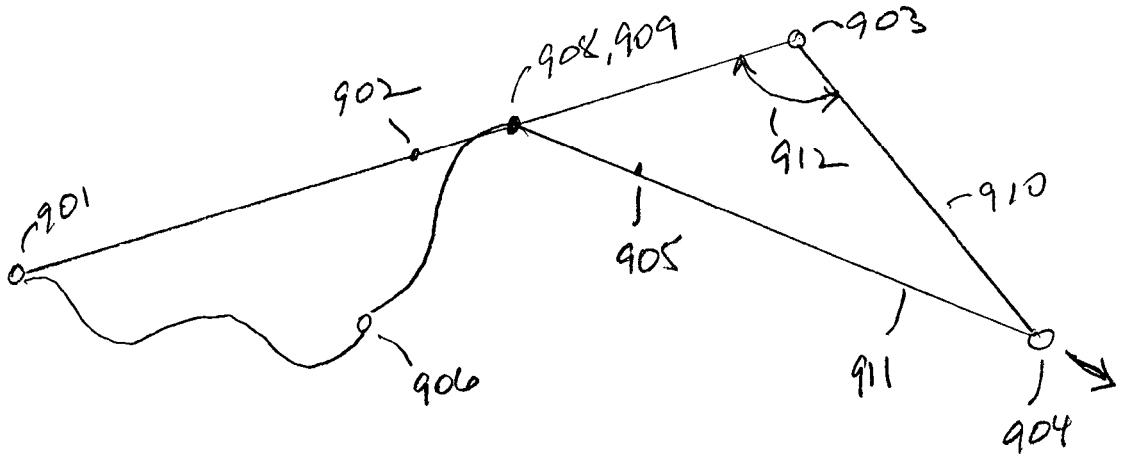

While embodiments have so far been described wherein the preselected point on the initial court side at which the hypotenuse mark is held while squaring the court is the midpoint or an end of the initial side, other preselected points may be used as well. For example, if the hypotenuse distance is 5/4 times the width of the court, and twelve hypotenuse indicators are made on the perimeter boundary, then each hypotenuse indicator can also serve as the preselected point at which another hypotenuse indicator is held. FIGS. 9A and 9B illustrate court perimeter boundary 900 in accordance with this fourth example embodiment of the invention. Court perimeter boundary 900 comprises corners 901, 903, 904, and 906, and also side midpoints 902 and 905. Boundary 900 also comprises 12 hypotenuse distance indicators 907, each placed a distance of 5/4 times the width from a corner or midpoint. Two particular hypotenuse distance indicator marks 908 and 909 will be used to illustrate the setup of perimeter boundary 900. In FIG. 9B, corners 901 and 903 and midpoint 902 have been secured to the ground. Hypotenuse distance indicator mark 908 is placed at indicator mark 909, and corner 904 is pulled until segments 910 and 911 are taut. Because each of hypotenuse distance indicator marks 908 and 909 is placed 5/4 of the court width from a corner and the court length is twice the court width, included angle 912 is a right angle. In other words, the preselected point at which hypotenuse distance indicator mark 908 is held during this setup step is itself another hypotenuse distance indicator mark 909. This symmetry is enabled by the distance from a corner or midpoint to each hypotenuse mark being 5/4 of the court width and the court length being twice the court width. The rest of the setup proceeds as previously described.

Figure 10:
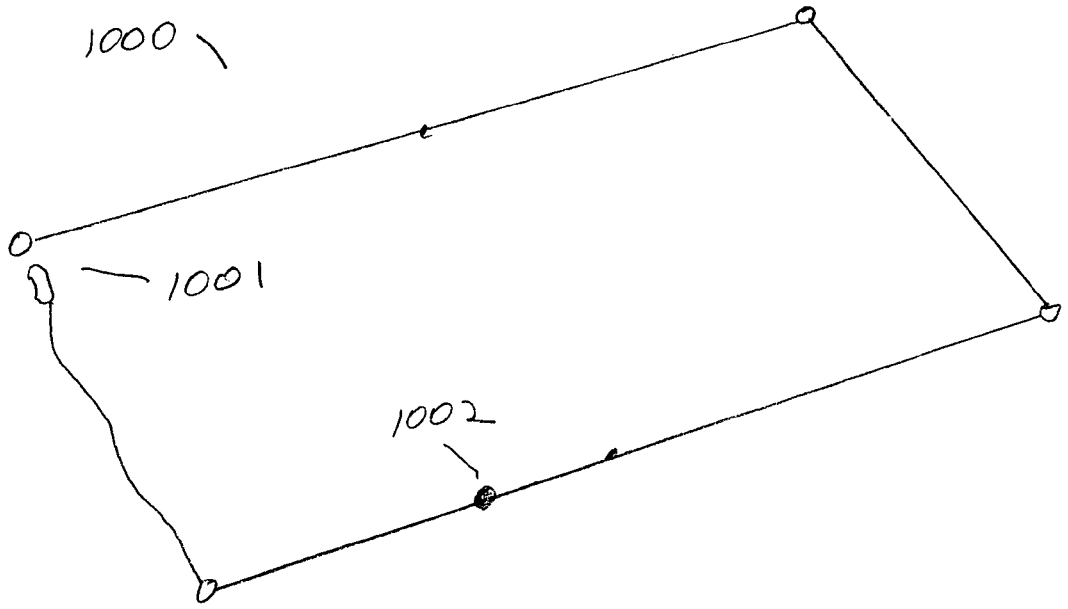
FIG. 10 shows a court perimeter boundary in accordance with a fifth example embodiment of the invention.

FIG. 10 shows a court perimeter boundary 1000 in accordance with a fifth example embodiment of the invention. Perimeter boundary 1000 comprises a hypotenuse distance indicator 1002, and is separable at corner 1001. That is, the segments meeting at corner 1001 may be separated from each other so that perimeter boundary 1000 is open and has two ends rather than forming a closed, endless loop. This arrangement facilitates winding perimeter boundary 1000 for storage, and may ease setup.

Figure 11A:
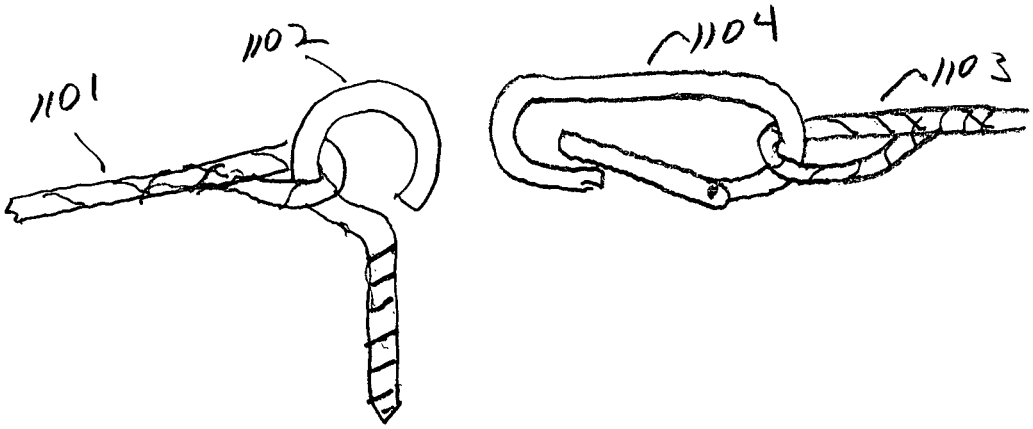
FIGS. 11A and 11B show an example method of making the perimeter boundary of FIG. 10 separable.
Figure 11B:
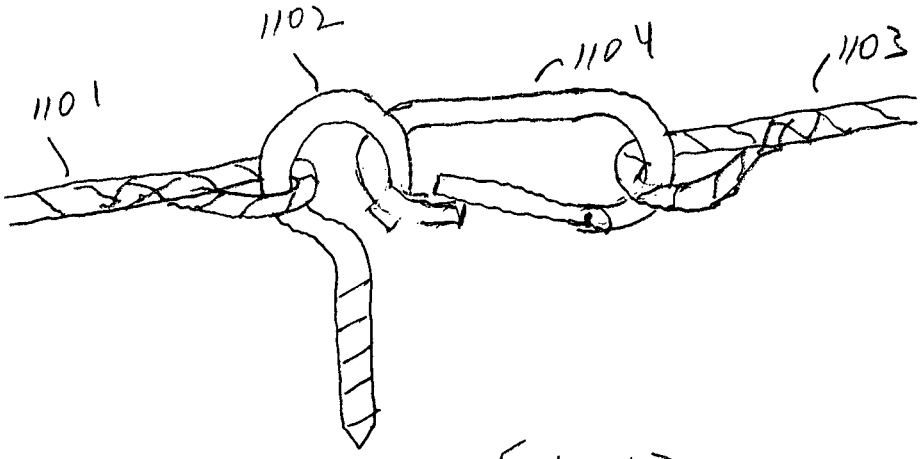

FIGS. 11A and 11B show an example method of making perimeter boundary 1000 separable. A first boundary segment 1101 is attached to an anchor 1102. A second boundary segment 1103 is attached to a clip 1104. Clip 1104 may be, for example, a snap-gate carabiner, a snap hook, or another kind of openable fastener. In the example of FIG. 11A, boundary segments 1101 and 1103 are made of nylon rope, attached to anchor 1102 and clip 1104 by braiding. Other attachment methods may be used as well. Preferably, the length of the rope forming perimeter segment 1103 is adjusted to account for the length of clip 1104, such that segment 1103, including clip 1104, is the proper length when clip 1104 is engaged with anchor 1102. In FIG. 11B, segments 1101 and 1103 have been joined by fastening clip 1104 to anchor 1102.

Figure 12:
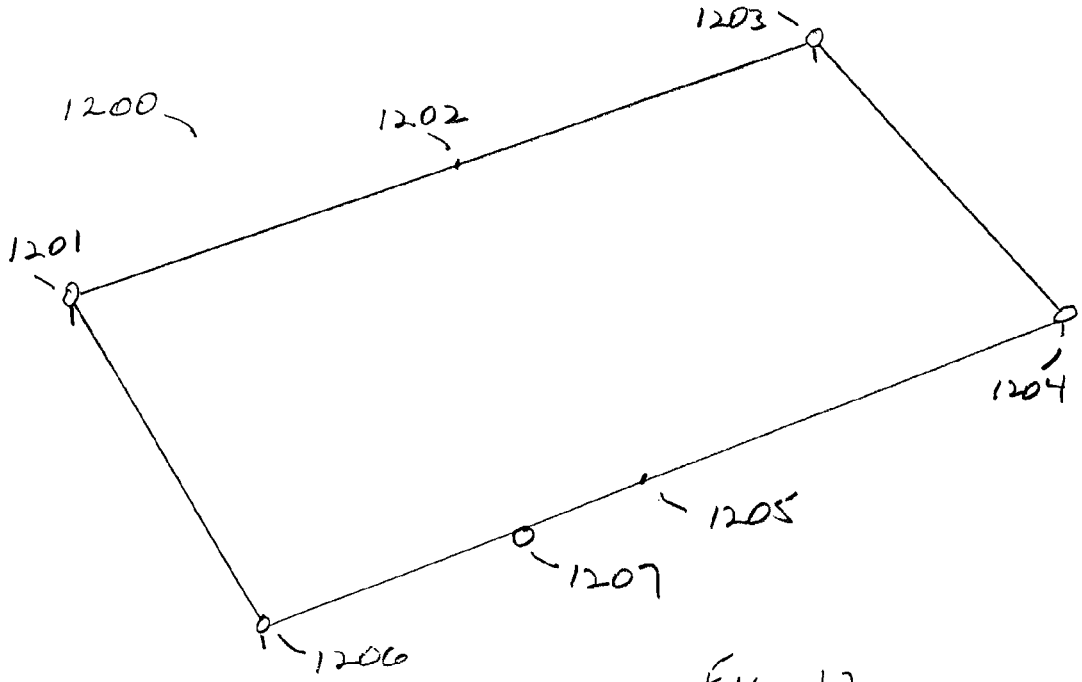
FIG. 12 shows a court perimeter boundary in accordance with a sixth example embodiment of the invention.
Figure 13:
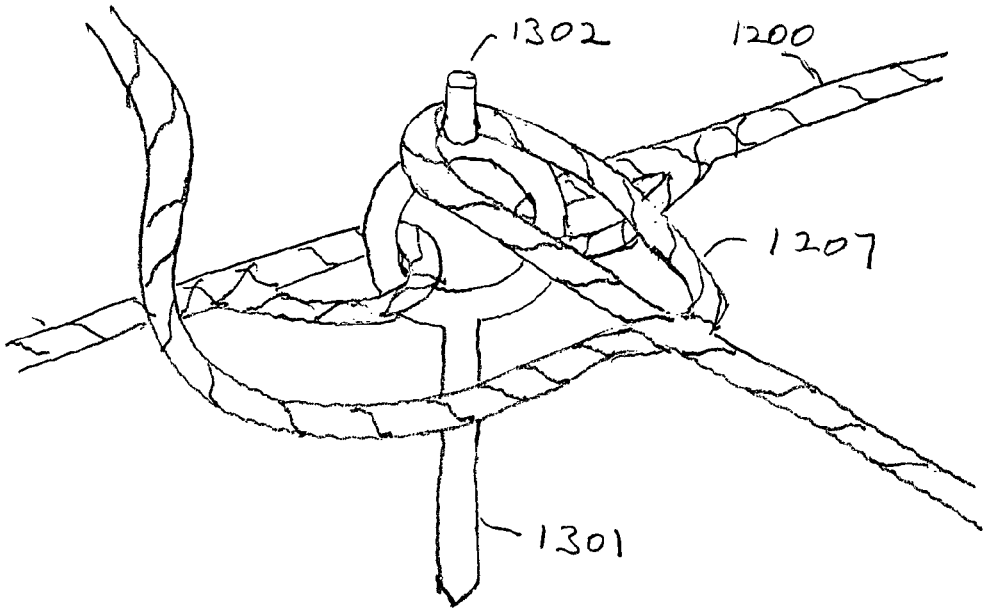
FIG. 13 shows a hypotenuse indicator loop being attached to an anchor, in accordance with an example embodiment of the invention.

FIG. 12 shows a court perimeter boundary 1200 in accordance with a sixth example embodiment of the invention. Perimeter boundary 1200 comprises corners 1201, 1203, 1204, and 1206, and long side midpoints 1202 and 1205. Perimeter boundary 1200 also comprises a hypotenuse distance indicator 1207, placed a hypotenuse distance away from corner 1204. In this example embodiment, hypotenuse distance indicator 1207 is a loop, and can be held at midpoint 1202 by temporarily attaching it to the anchor at midpoint 1202. FIG. 13 shows hypotenuse distance indicator loop 1207 being attached to anchor 1301 at midpoint 1202 by simply encircling a feature 1302 of anchor 1301 with hypotenuse distance indicator loop 1207. In this way, hypotenuse distance indicator 1207 is held at midpoint 1202 without the need for a person to remain at midpoint 1202. Hypotenuse distance indicator loop 1207 is positioned and sized so that corner 1204 is properly positioned when indicator loop 1207 is attached to midpoint 1202. This arrangement facilitates the setup of court boundary 1200 by one unassisted person. The unassisted person can place corners 1201 and 1203 and midpoint 1202, attach hypotenuse distance indicator loop 1207 to anchor 1301, and then place corner 1204 by drawing the segments adjacent corner 1204 taut.

Figure 14A:
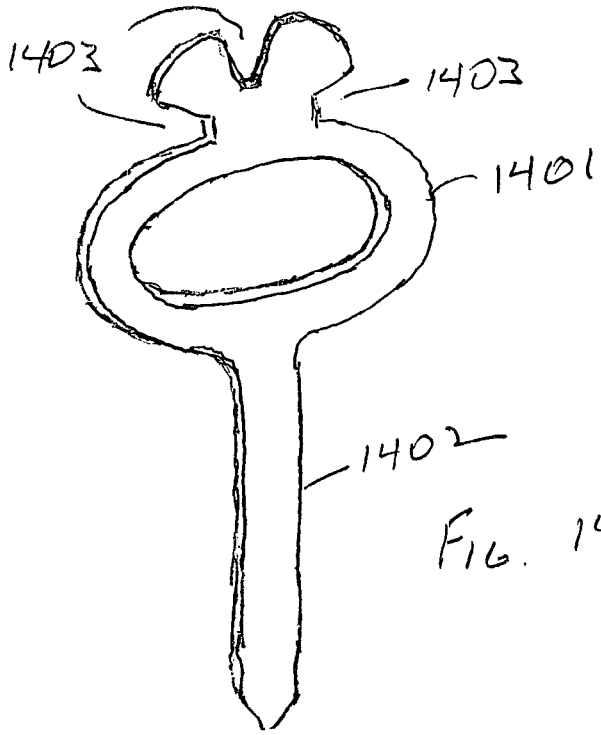
FIG. 14A shows an anchor in accordance with an example embodiment of the invention.
Figure 14B:
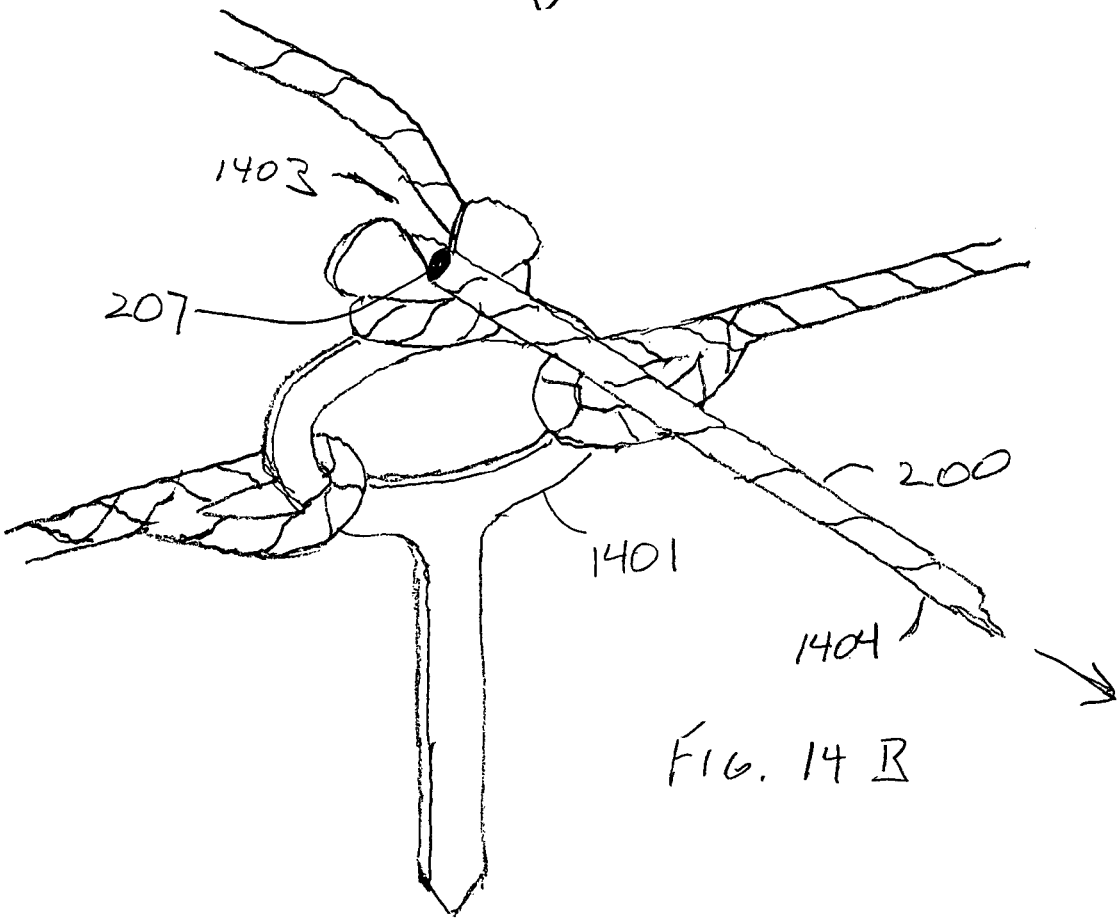
FIG. 14B shows the anchor of FIG. 14A with a perimeter boundary temporarily attached.

Alternatively, an anchor may have gripping features to temporarily hold a hypotenuse distance indicator. FIG. 14A shows an anchor 1401 with gripping features in accordance with an example embodiment of the invention. Anchor 1401 is preferably made of stamped sheet steel, but may be cast, forged, molded from plastic, or formed by some other method. Anchor 1401 comprises a tang 1402 for penetrating the ground, and also comprises notches 1403 sized so that the court boundary material can wedge into them. For example, if the court boundary material is ⅜ inch diameter nylon rope, notches 1403 may taper to a ¼ inch bottom width. A court perimeter boundary as boundary 200 shown in FIG. 2 may be set up by a single unassisted person using anchor 1401 at midpoint 202. FIG. 14B shows court perimeter boundary 200 temporarily attached to anchor 1401. Hypotenuse distance indicator mark 207 is wedged into the top notch 1403, and the perimeter segment comprising mark 207 is wrapped through the other two notches 1403. This attachment is secure enough, especially when tension is applied to segment 1404, to hold hypotenuse distance indicator mark 207 at midpoint 202 until corner 204 is anchored. The boundary may then be easily detached from anchor 1401 so that corner 206 may be placed. For safety, anchor 1401 is preferably made with a low profile and placed at a midpoint of the court, under the net, where it is unlikely to be stepped or fallen on.

Other methods of temporarily attaching a hypotenuse distance indicator are possible. For example, a hypotenuse distance indicator may be a clip or ring fastened to boundary 1200 and that attaches to a preselected point on the initial court side by clipping or snapping, by encircling an anchor feature, or by some other means. Or the hypotenuse distance indicator may attach magnetically to an anchor. A magnet may be embedded in or attached to the perimeter boundary at the hypotenuse distance indicator point, and attach to a ferrous anchor by magnetic attraction. Alternatively, the anchor may be magnetized and the hypotenuse indicator may include metal for attaching to the magnetized anchor. Other attachment methods are possible.

It is intended that the embodiments illustrated above be considered exemplary only and not as defining the scope of the invention, which is to be limited only by the appended claims viewed in light of the prior art.

The invention claimed is:

1. A perimeter boundary for a sport court, comprising:

at least four elongate flexible segments configured to form a rectangle having four corners, first and second of the corners being at ends of a first side of the rectangle, the first side including a preselected point; and a hypotenuse distance indicator placed on one of the boundary segments not included between the first and second corners, the hypotenuse distance indicator placed a hypotenuse distance, as measured along the boundary, from a point on the boundary defining a third one of the corners, wherein the hypotenuse distance is the distance between the third corner of the rectangle and the preselected point on the first side;

wherein the perimeter boundary is configured to separate so that the perimeter boundary is open and has two ends, and is further configured to reattach when in use so that the perimeter boundary forms a closed, endless loop;

and wherein each segment marks a portion of the court perimeter during play of the sport.

2. The perimeter boundary of claim 1, wherein the preselected point is a midpoint of the first side or an end of the first side.

3. The perimeter boundary of claim 1, wherein the hypotenuse distance indicator is configured to temporarily attach to the preselected point.

4. The perimeter boundary of claim 1, wherein the perimeter boundary can be set up by one unassisted person.

5. The perimeter boundary of claim 1, wherein the rectangle has a width and a length longer than the width, and wherein the hypotenuse distance is one of $\sqrt{2}$ times the width, $\sqrt{5}$ times the width, and 5/4 times the width.

6. A perimeter boundary for a sport court, comprising:

at least four elongate flexible segments configured to form a rectangle having four corners; and at least two hypotenuse distance indicators placed on the perimeter boundary, each hypotenuse distance indicator being a hypotenuse distance, as measured along the boundary, from a point on the boundary defining a respective one of the corners, wherein the hypotenuse distance is the distance between the respective corner and a respective preselected point on an initial side of the rectangle;

wherein each segment marks a portion of the court perimeter during play of the sport.

7. The perimeter boundary of claim 6, wherein the hypotenuse distance is selected such that any of the hypotenuse distance indicators can also serve as a preselected point.

8. The perimeter boundary of claim 6, wherein any of the corners can serve as an initial corner in setting up the perimeter boundary.

9. The perimeter boundary of claim 6, comprising twelve hypotenuse distance indicators.

10. The perimeter boundary of claim 6, wherein the perimeter boundary is configured to separate so that the perimeter boundary is open and has two ends, and is also configured to reattach for use so that the perimeter boundary forms a closed, endless loop.

11. The perimeter boundary of claim 6 wherein the rectangle has a width and a length longer than the width, and wherein the hypotenuse distance is one of $\sqrt{2}$ times the width, $\sqrt{5}$ times the width, and 5/4 times the width.

12. The perimeter boundary of claim 6, wherein the perimeter boundary can be set up by one unassisted person.

13. A method of setting up a perimeter boundary for a sport court on which a sport is to be played, the method comprising:

obtaining an elongate flexible perimeter boundary that is a loop configured to form a rectangular court having four corners, the perimeter boundary comprising a hypotenuse distance indicator placed on the perimeter boundary a hypotenuse distance away from a point on the perimeter boundary that serves as a third corner of the rectangular court, and wherein the perimeter boundary is configured to separate so that the perimeter boundary is open and has two ends, and is further configured to reattach when in use so that the perimeter boundary forms a closed, endless loop;

anchoring the perimeter boundary to a ground at two points that are first and second corners of the rectangular court, thereby forming an initial side of the rectangular court having the first and second corners at ends of the initial side;

holding the hypotenuse distance indicator at a preselected point on the initial side;

locating a third corner of the rectangular court by pulling a point of the perimeter boundary that will form the third corner until the boundary is taut between the third corner and the second corner and between the third corner and the preselected point at which the hypotenuse distance indicator is held, the positions of the preselected point and the hypotenuse distance indicator constraining a segment of the boundary between the initial side and the third corner to form a right angle with the initial side;

anchoring the perimeter boundary at the third corner; and after setup of the sport court perimeter boundary is complete, leaving the perimeter boundary in place to mark the court perimeter during play of the sport, each segment marking a portion of the court perimeter.

14. The method of claim 13, further comprising:

locating a fourth corner of the rectangular court by pulling the point of the perimeter boundary that will form the fourth corner until the boundary material is taut between the fourth corner and the first corner, and between the fourth corner and the third corner; and anchoring the fourth corner.

15. The method of claim 14, wherein the rectangular court has two short sides and two long sides, each long side comprising a midpoint, and wherein the method further comprises anchoring the midpoints of the long sides to the ground.

16. The method of claim 13, wherein the preselected point at which the hypotenuse distance indicator is held is the first corner.

17. The method of claim 13 wherein the preselected point at which the hypotenuse distance indicator is held is a midpoint of the first side.

18. The method of claim 13, wherein holding the hypotenuse distance indicator at the preselected point further comprises temporarily attaching the hypotenuse distance indicator to the boundary at the preselected point.

* * * * *